US006045443A

United States Patent [19]

Weston et al.

[11] Patent Number: 6,045,443

[45] **Date of Patent: *Apr. 4, 2000**

[54] METHOD AND APPARATUS FOR CONTROLLING THE DISPENSING OF MONEY

[75] Inventors: John Anthony Weston; Nigel Winstanley, both of Reading; Jacqueline Marshall, High Wyconbe, all of United Kingdom

[73] Assignee: Mars Incorporated, McLean, Va.

[ * ] Notice: This patent is subject to a terminal disclaimer.

[21] Appl. No.: 09/146,579

[22] Filed: Sep. 3, 1998

Related U.S. Application Data

[63] Continuation of application No. 08/640,868, filed as application No. PCT/GB94/02535, Nov. 17, 1994, Pat. No. 5,885,151.

[30] Foreign Application Priority Data

Nov. 17, 1993 [GB] United Kingdom ..... 9323701

[51] Int. Cl.[7] ..... G07D 1/06

[52] U.S. Cl. ..... 453/17; 194/217

[58] Field of Search ..... 194/217, 218; 453/2, 17, 20

[56] References Cited

U.S. PATENT DOCUMENTS

| | | | |
|---|---|---|---|
| 3,754,629 | 8/1973 | Douglas . | |
| 3,820,642 | 6/1974 | Levasseur . | |
| 3,841,456 | 10/1974 | Levasseur . | |
| 3,963,035 | 6/1976 | Levasseur . | |
| 4,188,891 | 2/1980 | Heiman . | |
| 4,192,972 | 3/1980 | Bertoglio et al. | 179/6.3 |
| 4,347,924 | 9/1982 | Hayashi et al. . | |
| 4,376,478 | 3/1983 | Sugimoto et al. | 194/218 |
| 4,462,512 | 7/1984 | Schuller | 194/217 |
| 4,491,140 | 1/1985 | Eglise et al. | 194/217 X |
| 4,499,982 | 2/1985 | Sugimoto et al. | 194/217 |
| 4,512,454 | 4/1985 | Schuller et al. | 194/346 |
| 4,587,984 | 5/1986 | Levasseuro et al. | 453/17 |
| 4,706,202 | 11/1987 | Kobayashi et al. | 364/479 |
| 4,763,769 | 8/1988 | Levasseur | 194/217 |
| 4,883,158 | 11/1989 | Kobayashi et al. | 194/217 |
| 5,092,816 | 3/1992 | Levasseur | 453/17 |
| 5,184,708 | 2/1993 | Levasseur | 194/217 |
| 5,542,519 | 8/1996 | Weston et al. | 194/217 |
| 5,595,277 | 1/1997 | Hoorman et al. | 194/217 |

FOREIGN PATENT DOCUMENTS

| | | | |
|---|---|---|---|
| 0 076 640 | 4/1983 | European Pat. Off. . | |
| 0 367 592 A2 | 5/1990 | European Pat. Off. | G07F 5/24 |
| 41 01 949 A1 | 7/1992 | Germany | G07F 5/24 |
| 2 269 258 | 2/1994 | United Kingdom | 453/20 |

*Primary Examiner*—F. J. Bartuska
*Attorney, Agent, or Firm*—Fish & Richardson P.C.

[57] ABSTRACT

A method of determining a combination of coins to be dispensed as change comprises determining a plurality of different possible combinations and selecting the most favorable one. For combinations which in sum are equal to the same amount, the most favorable combination is the one determined to leave the greatest number of coins available for change according to a predetermined criterion which takes into account the number of currently-available coins of at least one denomination. If two combinations are evaluated to be the same so far as change availability is concerned, the combination which comprises the least number of coins is selected.

16 Claims, 4 Drawing Sheets

INITIALISE
301
TUBE = HIGHEST
302
340
TUBE = NEXT LOWER
USE MAX. COINS
303
305
N
TUBE = LOWEST ?
304
Y
ANY COINS?
N
306
Y
ONLY LOWEST?
Y
308
307
N
FINISH
309
BEST COMB
Y
310
N
SAVE CURRENT COMB
350
REMOVE TUBE COINS FROM COMB.
311
CLEAR SCR
CLEAR SCR
TUBE = NEXT HIGHER
312
TUBE = HIGHEST?
Y
319
317
318
SCR SET
Y
320
N
313
N
ANY TUBE COINS USED?
N
314
USE BEST COMB.
Y
N
SCR SET?
315
Y
FINISH
316
REMOVE 1 COIN FROM COMB. SET SCR
321

402
RESIDUAL < STORED COMB.
Y
N
404
RESIDUAL = STORED COMB.
Y
N
406
EVALUATE AVAIL. FACTOR
408
AVAIL. FACTOR < STORED COMB
Y
N
410
AVAIL. FACTOR = STORED COMB
Y
N
412
NO. COINS < STORED COMB.
Y
N
311
310

METHOD AND APPARATUS FOR CONTROLLING THE DISPENSING OF MONEY

This is a continuation application of parent U.S. application Ser. No. 08/640,868 filed on Jul. 16, 1996, now U.S. Pat. No. 5,885,151, which is the abandoned phase of PCT/GB94/02535, filed Nov. 17, 1994.

BACKGROUND OF THE INVENTION

This invention relates to a method of, and an apparatus for, controlling the dispersing of money in the form of units having a plurality or denominations. The invention is particularly, but not exclusively, applicable to machines such as vending machines which receive coins of a plurality of denominations, and which have a plurality of stores each containing coins of a respective denomination, and each possibly being capable of being replenished by insertion of coins into the vending machine. Means are provided for dispensing coins from the stores in an amount which corresponds to the difference between the amount inserted, and the value of the vend or vends performed by the machine.

The invention is not limited to such arrangements. The dispensed monetary units could be, for example, banknotes, or a mixture of banknotes and coins. The invention also has wider applicability than vending machines; it may be applied to change-giving machines of any type.

In the field of vending machines, it is well known to use a dispensing control means which calculates a preferred combination of coins for dispensing in the form of change. One typical way of achieving this, referred to as the "least number of coins" method, involves using as many higher-denomination coins as possible, so that the total number of dispensed coins is minimized. This is intended to maximise the number of coins retained in the stores so that change remains available for the maximum number of transactions. Also, users of machines generally prefer their change in the form of fewer high-denomination coins.

GB-9216205.6 and PCT/GB93/01623 (referred to herein as the "earlier applications" and the contents of which are incorporated herein by reference) describe a particularly efficient technique for determining the combination of monetary units to be dispensed.

In such systems, there is often a tendency for the apparatus frequently to dispense the same denomination. For example, in machines that have many products that can be vended at a vend price of 40p, users will often insert 50p or £1 coins. Assuming that the machine can dispense a variety of different coin denominations, the "least number of coins" technique may result in the apparatus frequently selecting 10p, or a combination of a 50p and 10p, for dispensing as change. This reduces the number of available 50p and 10p coins for future change-giving operations. If for example the machine runs out of 10p coins, it may no longer be possible to give change, or perbaos only possible by using a large number of smaller-denomination coins which is less desirable from the point of view of the machine user.

SUMMARY OF THE INVENTION

According to one aspect of the present invention, there is provided a method of controlling the dispensing of money in the form of units available in a plurality of denominations, the method comprising determining at least two combinations of available units which each sum to a desired value, evaluating a change availability factor for each of said at least two combinations which takes into account the number of currently-available units of at least one denomination and which is indicative of the distribution of units which is left available for further dispensing, and selecting the combination to be dispensed according to the said evaluated factors.

Other aspects of the invention are set out in the accompanying claims.

The invention also extends to apparatus arranged to operate in accordance with the invention.

As a machine is used, the relative numbers of coins (or other units) of different denominations which are available for dispensing tends to vary, depending upon the types of units inserted, and the vend prices. The techniques of the present invention can be used to compensate at least partly for this change in distribution, so as to maintain as many different denominations available for as long as possible.

The invention may be embodied as an improvement of the technique described in the earlier applications. Accordingly, the machine may be arranged to determine a plurality of different combinations of coins each of which adds up to the value desired to be dispensed, in the way described in the earlier applications. That is, one combination is formed by allocating priority in order of denomination, with higher denominations having higher priority. Other combinations are formed in the same way, except that at least one denomination (excluding the lowest denomination) is allocated one less than the number which would be determined by a priority. This provides several candidates for combinations to be dispensed. In the earlier applications, the candidate involving the least number of units is dispensed. In the present invention, the candidate which is determined (according to a predetermined criterion) to have the least influence on future change availability is selected. Only if two combinations, both of which have the least influence on change availability, exist is the selection based on the combination with the least number of units.

It is not necessary to use the techniques of the earlier applications, but preferably whatever technique is used involves determining a plurality of different candidate combinations, and then for each combination evaluating a change availability factor. The factor would represent the influence on future change availability, and would preferably vary in a progressive manner depending upon the number of currently-available units of at least one denomination. That is, the factor is not merely one value or another depending upon whether the coin level is above or below a threshold, but can adopt more than two values depending on coin level. The factor may vary for example linearly or geometrically in accordance with the number of currently-available units. The factor preferably depends upon the number of currently-available units of at least two denominations, and it may be influenced differently by the different denominations. It may also be independent of the number of currently-available units of at least one denomination, which is particularly desirable if the availability of that denomination is unlikely to influence whether or not particular amounts of change can be provided. The factor may vary with the number of currently-available units only if that number is below a particular threshold, and this threshold may differ depending upon denomination.

BRIEF DESCRIPTION OF THE DRAWINGS

An arrangement embodying the invention will now be described by way of example with reference to the accompanying drawings, in which.

DESCRIPTION OF THE PREFERRED EMBODIMENTS

Figure 1:
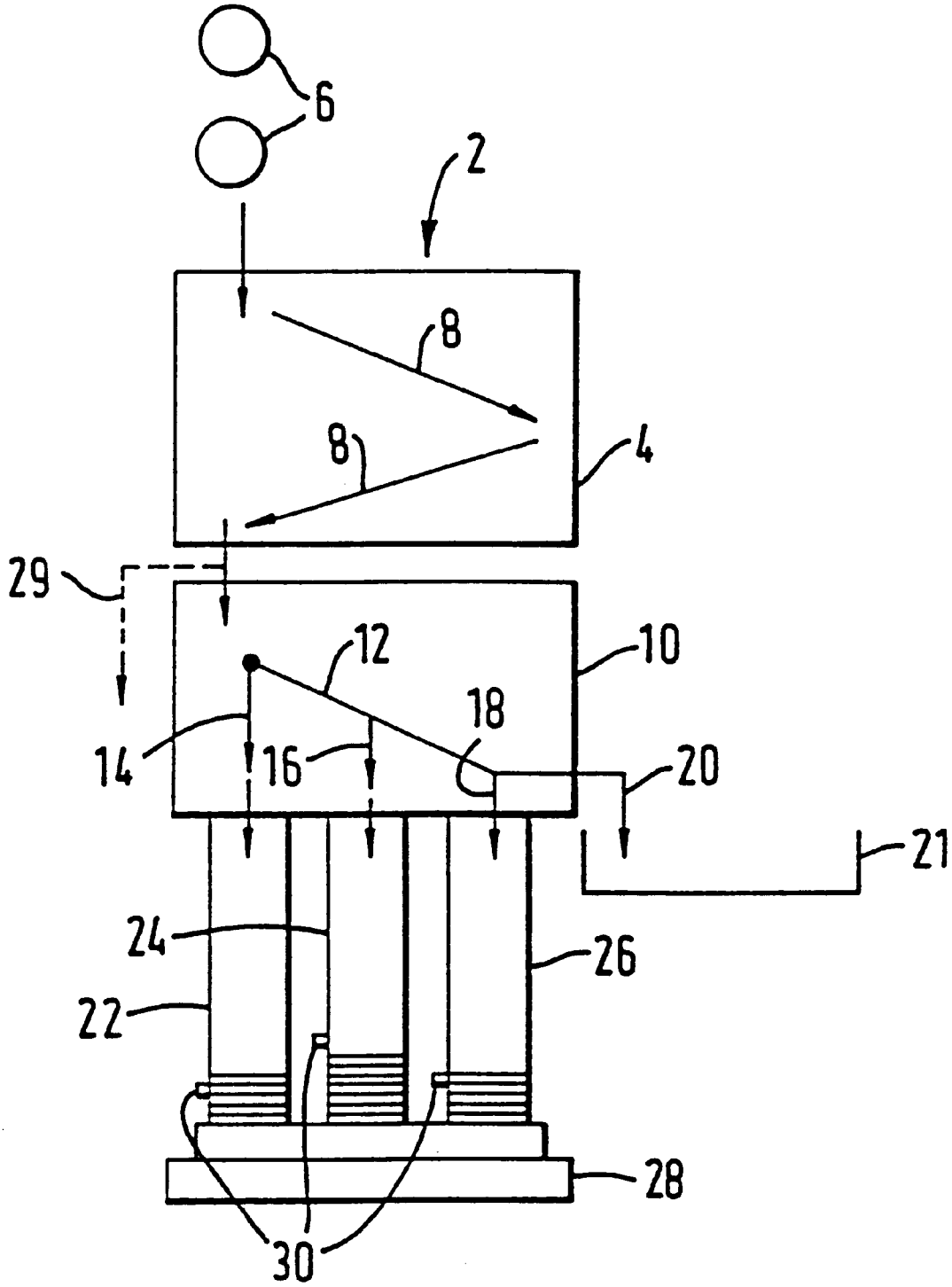
FIG. 1 is a schematic diagram of the mechanical part of a coin handling apparatus in accordance with the invention.

Referring to FIG. 1, the coin handling apparatus 2 includes a coin validator 4 for receiving coins as indicated at 6. During the passage of the coins 6 along a path 8 in the validator 4, the validator provides signals indicating whether the coins are acceptable, and if so the denomination of the coins.

Acceptable coins then enter a coin separator 10, which has a number of gates (not shown) controlled by the circuitry of the apparatus for selectively diverting the coins from a main path 12 into any of a number of further paths 14, 16 and 18, or allowing the coins to proceed along the path 12 to a path 20 leading to a cashbox 21. If the coins are unacceptable, instead of entering the separator 10 they are led straight to a reject slot via a path 29.

Each of the paths 14, 16 and 18 leads to a respective one of three coin tubes or containers 22, 24 and 26. Each of these containers is arranged to store a vertical stack of coins of a particular denomination. Although only three containers are visible in the figure, any number (and preferably at least four) may be provided.

Level sensors 30 are provided for indicating whether or not the number of coins in the respective tubes reaches a level determined by the position of the sensors.

A dispenser indicated schematically at 28 is operable to dispense coins from the containers when change is to be given by the apparatus.

Figure 2:
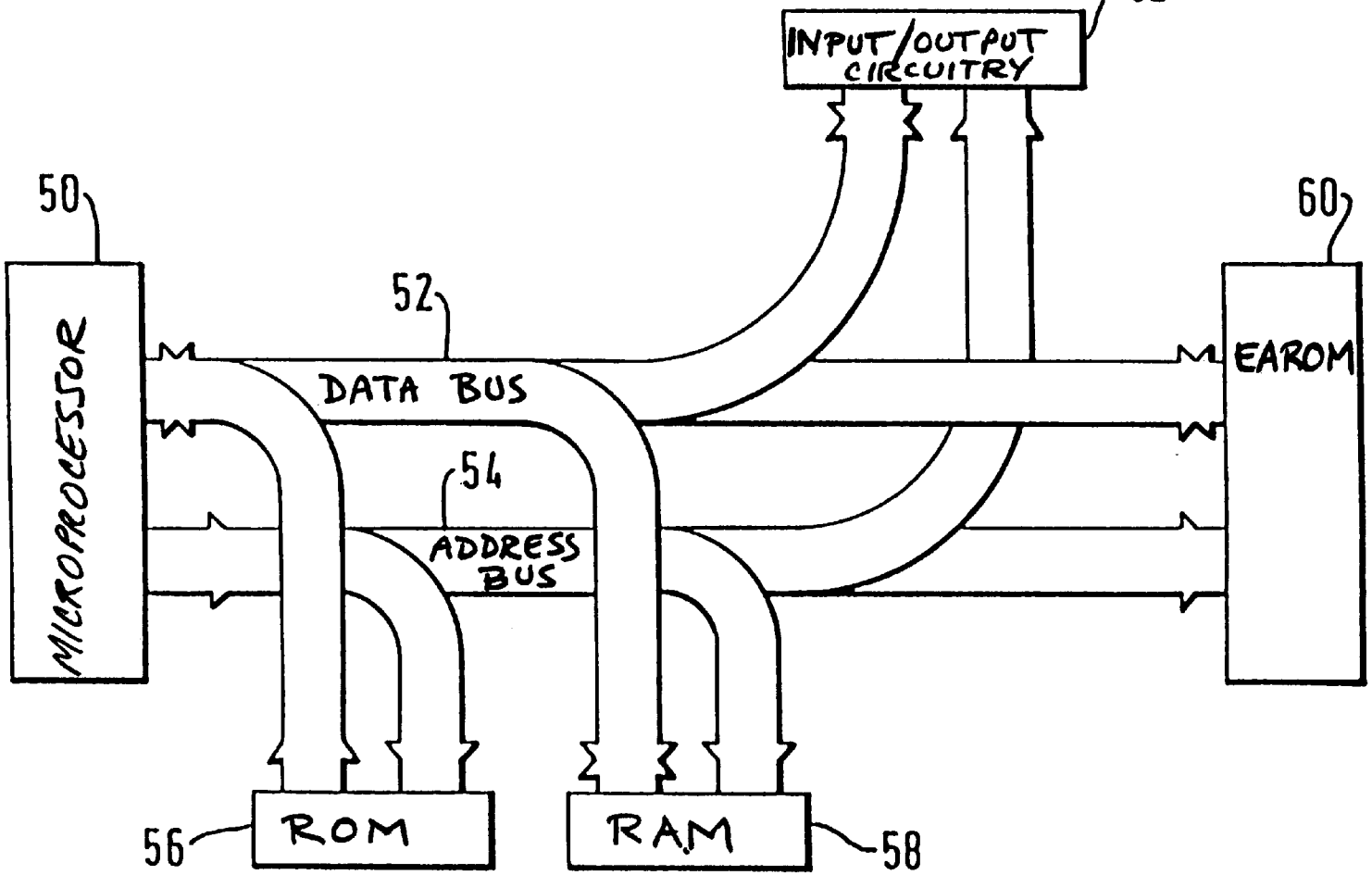
FIG. 2 is a block diagram of the circuit of the coin handling apparatus.

Referring to FIG. 2, the circuit of the present embodiment of the invention incorporates a microprocessor SO connected to data and address buses 52 and 54. Although separate buses are shown, data and address signals could instead be multiplexed on a single bus. A bus for control signals could also be provided.

The microprocessor 50 is connected via the buses 52 and 54 to a read-only memory (ROM) 56 and a random access memory (RAM) 58. The ROM 56 stores the program controlling the overall operation of the microprocessor 50, and the RAM 58 is used by the microprocessor 50 as a scratch-pad memory.

The microprocessor 50, the ROM 56 and the RAM 58 are, in the preferred embodiment, combined on a single integrated circuit.

The microprocessor 50 may also be connected via the buses 52 and 54 to an EAROM 60 for storing a variety of alterable parameters.

The microprocessor 50 is also coupled via the buses 52 and 54 to input/output circuitry indicated at 62. The circuitry 62 includes at least one level sensor 30 for each of the coin containers 22, 24 and 26, circuits for operating the dispenser 28 and the gates of the coin separator 10, the circuitry of the coin validator 4, and a display visible to a user of the apparatus for displaying an accumulated credit value and an indication when insufficient coins are stored to guarantee that change will be available.

The input/output circuitry 62 also includes an interface between the control circuit of the apparatus and a vending machine to which it is connected.

In operation of the apparatus the microprocessor 50 successively tests the signals from the validator to determine whether a coin has been inserted in the apparatus. When a credit has been accumulated, the microprocessor also tests signals from the vending machine to determine whether a vending operation has been carried out. In response to various signals received by the microprocessor 50, various parts of the program stored in the ROM 56 are carried out. The microprocessor is thus arranged to operate and receive signals from the level sensors 30 of the coin containers 22, 24 and 26, and to control the gates in the separator 10 in order to deliver the coins to the required locations, and is also operable to cause appropriate information to be shown on the displays of the apparatus and to deliver signals to the vending machine to permit or prevent vending operations. The microprocessor is also operable to control the dispenser to deliver appropriate amounts of change.

As part of this procedure, the microprocessor keeps track of the number of coins in each of the containers 22, 24 and 26. This can be done by keeping a running total which is altered as coins are sent to and dispensed from the containers, the running total being recalibrated in response to the level sensor 30 of the associated coin container becoming covered or uncovered as the level of coins changes. The techniques may correspond to those disclosed in EP-A-0076640.

The arrangement so far is quite conventional, and the details of particular structures suitable for using as various parts of the mechanism will therefore not be described in detail.

The particular sequence of most of the operations carried out by the microprocessor may be the same as in previous apparatus. A suitable program to be stored in the ROM 56 can therefore be designed by anyone familiar with the art, and accordingly only the operations carried out by the particularly relevant parts of this program will be described.

Figure 3:
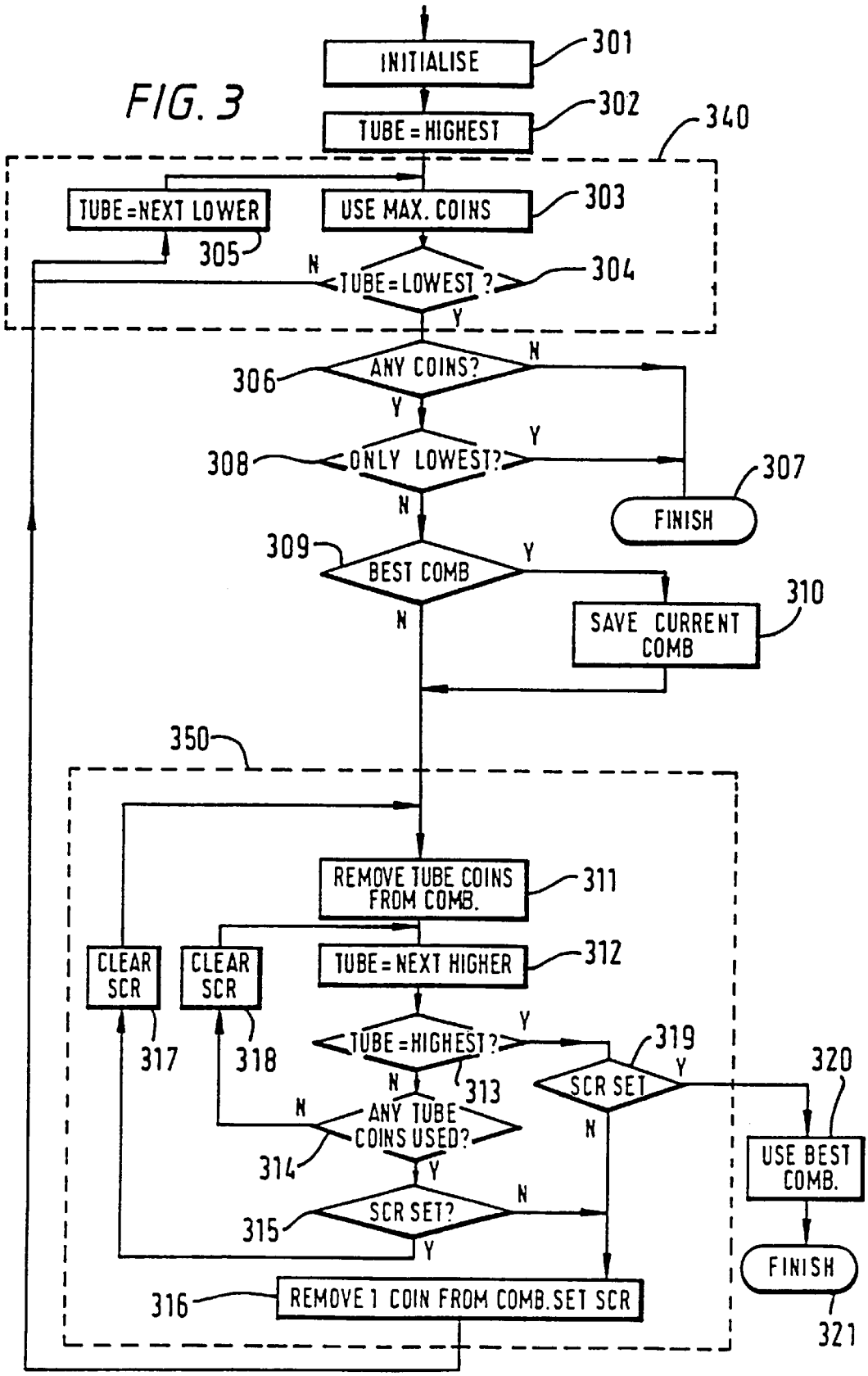
FIG. 3 is a flow chart explaining how the circuit calculates a combination of coins to be paid out as change.

Assuming that money has been inserted into the machine, and a product has been selected for vending, then the microprocessor performs a routine as set out in FIG. 3 to determine the coins to be dispensed.

At step 301, various variables are initialised, and the amount to be dispensed is set equal to the difference between a credit value, in this case representing the amount of cash inserted, and the price of one or more vended products or services. Then, step 302, a variable TUBE is set equal to a number representing the container storing the highest-denomination coins. At step 303, the processor calculates the maximum number of coins from the current TUBE which can be used in the dispensing of change. The total value of these coins must not exceed the amount to be dispensed. The actual number will depend upon the availability of the coins. In the preferred embodiment, the availability of coins in each of the containers is indicated by respective counts CC, each of which indicates the number of coins in the container. A denomination is considered unavailable (so that coins of this denomination will not be dispensed) when the associated number falls to a predetermined low level (possibly zero).

The processor then determines the residual amount to be dispensed, which corresponds to the difference between the amount desired to be dispensed and the total value of the maximum number of coins calculated during step 303.

The processor then proceeds to step 304, in which it determines whether the current TUBE corresponds to the TUBE associated with the lowest denomination. As this point has not yet been reached, the program loops to step 305, wherein the variable TUBE is set to correspond to the container storing the next-lower denomination, and then the program proceeds again to step 303. Here, the processor determines the maximum number of coins of the denomination of the current TUBE which can be used to provide the residual amount to be dispensed.

The program loops through steps 303, 304 and 305 until all denominations have been taken into account, at which time the program proceeds to step 306.

The steps 303, 304 and 305 form a subroutine 340 which starts with a given denomination and progressively moves to the lowest denomination, each time using as many coins as possible to form a combination to be dispensed. By starting with the highest denomination, the resulting combination will correspond to that which would be calculated by prior-art arrangements which attempt to produce a combination involving the least number of coins.

The step 306 determines whether the currently-determined combination of coins consists of no coins at all. This would be the case for example if no coins were available. If so, the change calculation routine finishes as indicated at step 307.

Otherwise, the program proceeds to step 308, where it determines whether the current change calculation consists only of coins of the lowest value. If so, then no better combination can be found, and the routine ends at step 307.

Otherwise, the program proceeds to step 309. This step, which will be explained in more detail below, determines whether the current change calculation represents the best change calculation evaluated so far. This determination is primarily based on the residual dispensing amount i.e. the difference between the total value of the calculated combination and the desired amount to be dispensed. If so, the current combination is saved at step 310.

The program then proceeds to a subroutine 350, which will be described more fully below. The purpose of the subroutine 350 is to (a) remove from the current combination a single coin of a selected denomination (called the "restore" denomination), and set a "single-coin-restored" flag SCR for this denomination, and (b) remove from the current combination all coins of lower denominations. This therefore increases the residual amount to be dispensed. The program then loops back to the subroutine 340, starting with step 305 to reduce the value of TUBE to indicate the denomination lower than the "restore" denomination. The subroutine 340 will therefore recalculate a combination of coins to be dispensed by allocating higher priority to higher denomination coins, starting with the denomination lower than the "restore" denomination.

The first time the subroutine 350 is entered, the flag SCR will be set for the second-lowest denomination. The second time the subroutine 350 is entered, the flag SCR will be cleared for the second-lowest denomination and set for the third-lowest denomination. The next time, the SCR flag will be set for the second- and third-lowest denomination. This will continue until the flag SCR has been set for each denomination (except for the lowest) and for each combination of those denominations. However, if a combination of coins excludes a particular denomination, then it will not be possible to deduct one from the number of coins to be dispensed, so the setting of the SCR flag for that denomination is skipped.

Using the example given in the earlier applications, when there are four change tubes storing respectively the denominations 50p, 20p, 2p and 1p, the following lists the various combinations considered at step 309, followed by the denominations for which the SCR flags are set after subsequent execution of the subroutine 350, to dispense a total of 63p. It is to be noted that the "restore" denomination is the lowest denomination for which the SCR flag is set.

| | 50p | 20p | 2p | 1p |
|---|---|---|---|---|
| Combination 1 | 1 | 0 | 6 | 1 |
| SCR set | | | * | |
| Combination 2 | 1 | 0 | 5 | 3 |
| SCR set | * | | | |
| (Note: 20p denomination skipped because number of coins = 0.) | | | | |
| Combination 3 | 0 | 3 | 1 | 1 |
| SCR set | * | | * | |
| Combination 4 | 0 | 3 | 0 | 3 |
| SCR set | * | * | | |
| Combination 5 | 0 | 2 | 11 | 1 |
| SCR set | * | * | * | |
| Combination 6 | 0 | 2 | 10 | 3 |

In the earlier applications, combination 3 is selected, because this involves the least number of coins.

The subroutine 350 operates as follows. First, at step 311, the program adds to the residual amount the total value of the coins in the current combination which have the denomination associated with the current value of TUBE (which at this stage will be the lowest denomination). The current combination is altered so that these coins no longer form part of that combination.

At step 312, the value of TUBE is set to correspond to the next-higher denomination. Then, at step 313, the program determines whether the value of TUBE corresponds to that associated with the highest denomination. If not, the program proceeds to step 314. This step checks whether the number of coins in the current combination which have a denomination corresponding to TUBE is greater than zero. If not, then the program immediate moves back to step 312, via a step 318 (in which the SCR flag for the current TUBE is cleared) so as to set TUBE to correspond to the next-higher denomination.

If the number of coins is determined at step 314 to be greater than zero, the program proceeds to step 315, where the program checks to determine whether the SCR flag associated with current TUBE is set. Assuming the flag is still clear, the program proceeds to step 316.

At step 316, the program will add to the residual amount the value of a single monetary unit of the denomination associated with the current TUBE (the "restore" denomination), and will change the current combination to indicate that this unit no longer forms part of that combination. Also at step 316, the associated SCR flag is set.

During subsequent executions of subroutine 350, the program will respond to detection of an SCR flag in the "set" condition by looping back from step 315 to steps 317, 311, 312. Therefore, starting with the second-lowest denomination, whenever the SCR flag is found to be set, the flag is cleared, until there is found a denomination for which SCR is not set. At this point, the program moves to step 316 to select a new "restore" denomination and set the associated SCR flag.

Thus, each time the subroutine 350 is executed, the number and denominations of coins remaining in the combination, and the residual amount, will be different.

The subroutine 350 is repeatedly executed until the SCR flag has been set for all denominations (except the lowest). In this situation, when the subroutine 350 is next executed, step 315 will repeatedly cause the program to loop back to step 311, until the highest denomination is reached. The program will then proceed from step 313 to step 319, and then to step 320 in which the best combination as determined at step 310 is used to set variables which are used in the control of the dispenser. The routine finishes at step 321.

The dispensing operation is monitored, and if at any time the dispenser fails to dispense a coin of the calculated combination, a new dispensing amount is calculated by reducing the original dispensing amount by the total value of the coins so far dispensed, and then executing the routine of FIG. 3 again to calculate a new combination of coins for dispensing the remaining amount.

Figure 4:
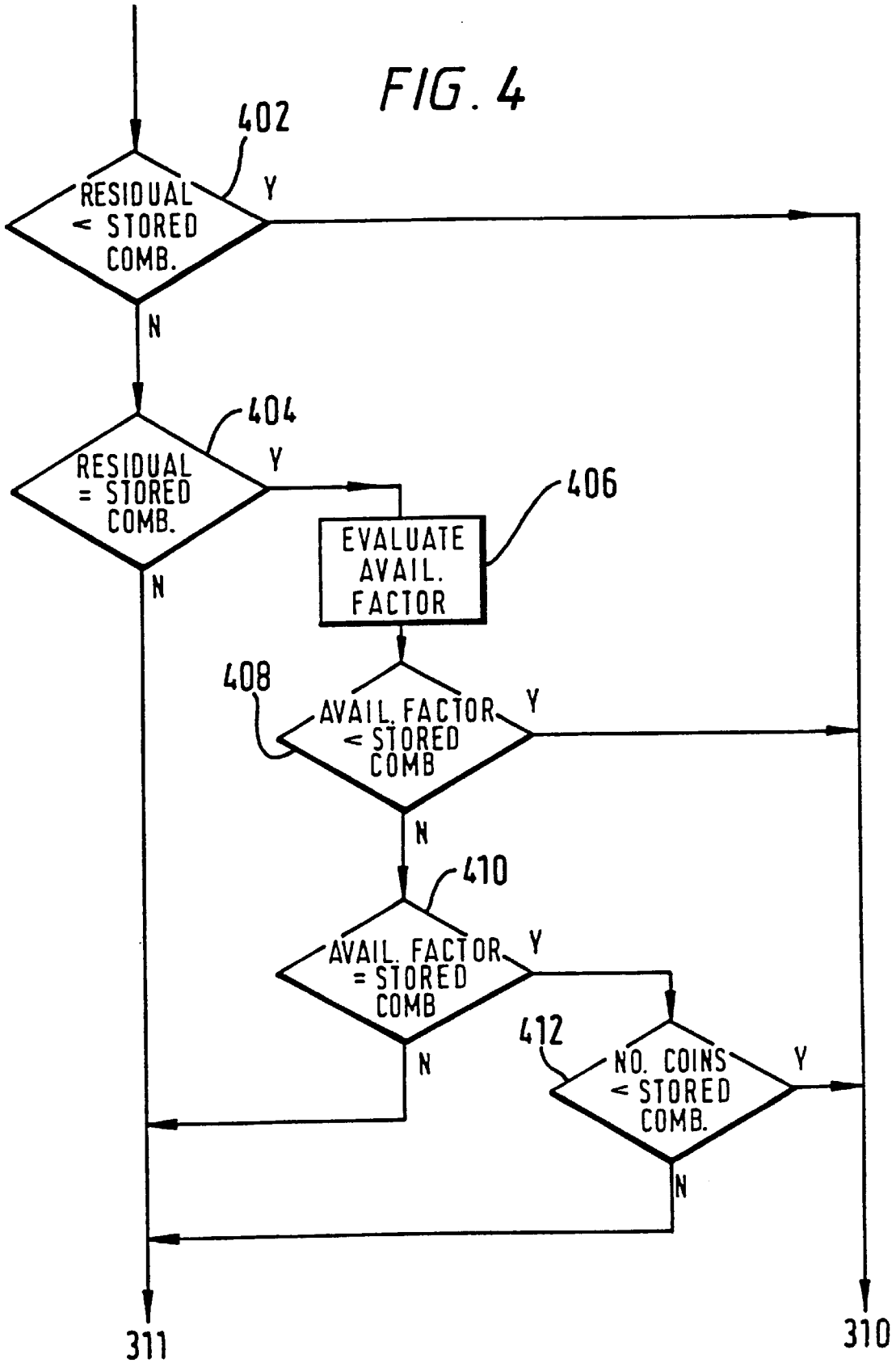
FIG. 4 shows one of the steps of the FIG. 3 flow chart in more detail.

The routine so far described corresponds to that described in the earlier applications. The main difference lies in the step 309 for determining whether the current combination of coins is the best combination so far evaluated. This step 309 is shown in more detail in FIG. 4.

To carry out step 309, the program first determines whether the residual value of the current combination (i.e. the amount by which the change will fall short of the desired amount to be dispensed) is less than the residual amount of the currently-stored best combination. If so, then the program determines the new combination to be the best so far, and proceeds to step 310. This will be the route taken for the first-determined combination.

Otherwise, the program will proceed from step 402 to step 404, wherein it will determine whether the residual amount is equal to the residual amount of the currently-stored best combination. If not, this means that the residual amount must be greater than that of the currently-stored best combination, so the program proceeds straight to step 311.

Otherwise, the program proceeds to step 406, wherein the program determines a change availability factor for the current combination. This factor is calculated as follows. For each denomination forming the combination, there is calculated a number which is dependent upon the number of currently-available coins of that denomination minus the number of coins of that denomination which are used to form the combination. The availability factor for any given combination is equal to the sum of the individual numbers for the denominations forming that combination.

In a particular preferred embodiment, each denomination is associated with a threshold level TL. Assuming that the number of coins currently available in that denomination is CC, and the number of coins of that denomination within the combination is NC, then the availability factor for that denomination is TL−(CC−NC), or zero if TL<CC−NC. The total availability factor for the combination is the sum of the availability factors for the respective denominations forming that combination. Therefore, the more a particular combination would tend to reduce the level of coins below the respective threshold levels, the greater would be the availability factor.

At step 408, the program determines whether the availability factor for the present combination is less than the availability factor for the currently-stored best combination. If so, then the current combination is determined to be better, and the program proceeds straight to step 310.

Otherwise, the program proceeds to step 410, where it is determined whether the availability factor for the current combination is equal to that of the currently-stored best combination. If not, i.e. if the current combination has a worse (higher) availability factor, then the program determines that it cannot be a better combination than that currently stored, and the program proceeds to step 311.

Otherwise, if the availability factors for the current combination and the stored best combination are equal, the program proceeds to step 412. Here, if the program determines that the number of coins forming the current combination is less than that forming the stored best combination, the program decides that the current combination is better than the currently stored best combination, and proceeds straight to step 310. Otherwise, the program proceeds to step 311.

Accordingly, the program when determining the best combination will aim first to minimise the residual amount, second (if the residual amounts are equal) to minimise the availability factor, and third (if the residual amounts and availability factors are equal) to minimise the number of coins dispensed.

As an example, it is assumed that the change tubes store coins of the denominations 50p, 20p, 10p and 5p. It is assumed also that the machine is repeatedly required to dispense change in the amount of 60p.

Assuming first that the level of all the coins in the change tubes exceeds the respective trigger levels, then the machine will repeatedly dispense a single 50p and a single 10p coin to form the 60p combination. The residual amount of this combination will be zero, and the availability factor will be zero.

Assuming that the lop then reaches the threshold level TL, i.e. CC=TL, then the availability factor for the 50p+10p combination will be TL−(TL−1)=1. However, the availability factor for the 50p+5p+5p combination will be zero, and therefore this latter combination will be paid out. This may then continue until the level of the 5p coin reaches TL, at which point the availability factor for the 50p+5p+5p combination will increase, and therefore the machine will switch to dispensing a 20p+20p+20p combination.

On the other hand, if the level of 50p coins reaches TL, but all the other coins are above their threshold levels, the pay out will switch from 50p+10p (giving an availability factor of 1) to 20p+20p+20p. This will continue until the 20p level reaches TL, at which point the change pay out will switch to 6×10p.

By way of another specific example, it is assumed that all four denominations are at their threshold levels, and that the machine is then caused repeatedly to pay out 60p in change. On the first 9 occasions it is required to pay out change in these circumstances, the combination (and the associated availability factors for those combinations) will be as follows:

| Combinations | Availability Factor |
|---|---|
| 50p, 10p | 2 |
| 20p, 20p, 20p | 3 |
| 50p, 10p | 4 |
| 50p, 5p, 5p | 5 |
| 20p, 20p, 20p | 6 |
| 50p, 10p | 7 |
| 50p, 10p | 9 |
| 20p, 20p, 20p | 9 |
| 50p, 5p, 5p | 10 |

In this instance, it will be noted that the total number of coins dispensed is 4×5p, 4×10p, 9×20p and 6×50p. The result of this is that there is a broader distribution of dispensed coins compared with the arrangement in the earlier applications so that more denominations remain available for longer.

This technique can be modified in a number of ways. For example, the threshold for an individual denomination may be equal to the maximum capacity of the container for the respective denomination, so that the level of coins in that container will always have an influence upon whether that denomination is selected for dispensing. On the other hand, the levels of particular denominations could be disregarded in calculating the availability factor, e.g. by setting their threshold to zero.

In addition to, or instead of, having different threshold levels for different denominations, the arrangement may be such that changes in the number of currently-available units of one denomination have a different effect on the availability factor from changes in the number of currently-available units of a different denomination. For example, there may be different scaling factors such that, if the level of a first denomination changes by one, then a coin of that denomination will add n to the availability factor, whereas for a different denomination a change of one unit will add m to the availability factor, where n<m.

Furthermore, with the arrangement described above, when a particular denomination is included in the combination to be dispensed, each additional coin of that denomination only adds one to the total availability factor for that combination, so there is a bias towards dispensing coins of the same denomination if several denominations are below the threshold level. As an alternative, each individual coin may contribute to the availability factor an amount which is independent of whether any other coins of the same denomination are included in the combination. For example, the availability factor contributed by each coin may be equal to the difference between the threshold level and the actual level of coins in the change tube reached as a result of dispensing that coin. Thus, if the current level of 20p coins is 6 below the threshold, a first 20p included in a combination to be dispensed would contribute an availability factor of 7, and second 20p an availability factor of 8, making a total of 15. This changes the dependence of availability factor on coin level from a linear progression to a geometric progression.

Following the execution of the routine of FIG. 3, if desired, the microprocessor may be arranged to illuminate a display indicating that insufficient change is available in response to a determination that the best combination produces coins which total less than the desired amount of change. The user may then act by changing the product selected for vending, by selecting a further product or by cancelling the selected product and obtaining a refund of the inserted cash.

The preferred embodiment described above dispenses money from stores replenished by a serviceman or as a result of a series of transactions carried out by the machine. Alternatively, the invention can be applied to arrangements in which the money is dispensed from a store or stores containing only those monetary units inserted for the current transaction.

It will be noted that the determination of the combination of units to be dispensed is independent of the denominations of units inserted to obtain credit.

It will be noted that the technique described above has the advantage that the same processing routines can be carried out irrespective of the particular denominations which the apparatus is designed to receive and dispense, irrespective of the vend prices and indeed irrespective of the currency. To handle different situations it is merely necessary to have a memory storing the relative values of the different denominations handled by the apparatus. Preferably, for each dispensing container, the memory also stores parameters representing the way the availability factor alters in response to changes in the level in that container, e.g. a threshold level and/or a scaling factor.

We claim:

1. A method of dispensing change using coins selected from a set of denominations, the method comprising selecting between different change combinations that sum to a desired dispense amount, wherein, when all denominations in the set are available for change irrespective of the selected combination, a decision is made during a dispensing operation and prior to dispensing any coin, the decision determining whether:

(a) coins are dispensed according to a higher denomination priority principle, taking into account all of said denominations, whereby a relatively high denomination coin is dispensed in preference to relatively low denomination coins which sum to an amount equal to the relatively high denomination coin, or whether (b) coins are dispensed according to a modified version of the higher denomination priority principle, wherein the modified version results in an exception being made to the higher denomination priority principle; and dispensing coins in accordance with the decision, and without being influenced by changes in the number of available units occurring as a result of the dispensing operation.

2. A method of controlling the dispensing of money in the form of units of each of a plurality of denominations from a money handling apparatus, when units of each of said plurality of denominations are available for dispensing, comprising:

(a) providing at least two alternative principles according to combinations of units which each sum to the desired dispense amount; and (b) selecting in the apparatus between the principles, wherein the alternative principles include:

(i) a higher denomination priority principle, whereby relatively high denomination units are dispensed in preference to relatively low denomination units; and (ii) a modified version of the higher denomination priority principle, the modified version including only a single exception to the higher denomination priority principle, irrespective of the quantities of units of each of said plurality of denominations which are available for dispensing.

3. A method of controlling the dispensing of money from an apparatus holding money in the form of units of each of a plurality of denominations, when units of each of said plurality of denominations are available for dispensing, comprising:

(a) providing at least two alternative principles according to combinations of units which each sum to a desired dispense amount; and (b) selecting in the apparatus between the principles, wherein the alternative principles include:

(i) a higher denomination priority principle, whereby relatively high denomination units are dispensed in preference to relatively low denomination units for each unit, to form a combination summing to the desired dispense amount; and (ii) a modified version of the higher denomination priority principle, the modified version including a predetermined variation of the higher denomination priority principle for a selected denomination, the predetermined variation being employed only once to form a combination summing to the desired dispense amount, irrespective of the quantities of units of each of the plurality of denominations which are available for dispensing.

4. A method of controlling the dispensing of money from an apparatus holding money in the form of units of each of a plurality of denominations, when units of each of said plurality of denominations are available for dispensing, comprising:

(a) providing at least two alternative principles according to combinations of units which each sum to a desired dispense amount; and (b) selecting in the apparatus between the principles, wherein the alternative principles include:

(i) a higher denomination priority principle, whereby a relatively high denomination unit is dispensed in preference to relatively low denomination units; and (ii) a modified version of the higher denomination priority principle, the modified version involving dispensing, for one of said denominations, a number of units which differs from that determined according to the higher denomination priority principle, wherein the remaining dispense amount is dispensed according to the higher denomination priority principle irrespective of the quantities of units of each of said plurality of denominations which are available for dispensing.

5. A method of controlling the dispensing of money from an apparatus holding money in the form of units of each of a plurality of denominations, when units of each of said plurality of denominations are available for dispensing, comprising:

formulating in the apparatus dispensing combinations which result from at least two alternative combination-forming principles that each provide combinations having total values equal to desired dispense amounts calculated by subtracting vend prices from credit values, the principles including:

(i) forming a combination by considering the denominations in value order, with higher value denominations taking priority, to include a unit of a higher denomination in the combination in preference to lower denomination units whenever possible;

(ii) forming a combination by considering the denominations in value order, with higher value denominations taking priority, to include a unit of a higher denomination in the combination in preference to lower denomination units whenever possible except, for at least one denomination chosen irrespective of the quantities of units of each of said plurality of denominations which are available for dispensing, considering at least one denomination unit out of value order to include that unit in said combination, which unit may otherwise not have appeared in said combination.

6. A method according to claim 5, wherein said at least one denomination unit is considered out of value order by reducing the number of units of the next higher denomination by one.

7. A method of controlling the dispensing of money from an apparatus holding money in the form of units of each of a plurality of denominations, comprising:

selecting in the apparatus for dispensing during different dispensing operations, when units of each of said plurality of denominations are available for dispensing, a plurality of different combinations, which each sum to the same desired dispense amount calculated by subtracting a vend price from a credit value, the plurality of different combinations including a combination which results from considering the denominations in value order, with higher value denominations taking priority, so as to include a unit of a higher denomination in preference to units of a lower denomination and, only once, irrespective of the quantities of units of each of said plurality of denominations which are available for dispensing, replacing one unit of a higher denomination from the combination with lower denomination units.

8. A money handling apparatus for controlling the dispensing of money in the form of units having a plurality of denominations, comprising:

means for determining a desired dispensing amount;

means for determining at least two different combinations of units which in total equal the dispensing amount; and means for selecting one of the combinations for dispensing, wherein the selection means chooses between at least:

a higher denomination priority principle combination, whereby relatively high denomination units are dispensed in preference to relatively low denomination units; and a modified higher denomination combination principle, wherein an exception to the higher denomination priority principle occurs, irrespective of the quantities of units of each of the plurality of denominations which are available for dispensing.

9. Money handling apparatus for controlling the dispensing of money in the form of units having a plurality of denominations, comprising:

means for determining a desired dispensing amount;

means for determining at least two different combinations of units which in total equal the dispensing amount; and means for selecting one of the combinations for dispensing, wherein the means for selection chooses between at least:

a higher denomination priority principle combination, whereby relatively high denomination units are dispensed in preference to relatively low denomination units; and a modified higher denomination combination principle, whereby a predetermined variation of the higher denomination priority principle is employed only once to form a combination summing to the desired amount, irrespective of the quantities of units of each of the plurality of denominations which are available for dispensing.

10. Money handling apparatus for controlling the dispensing of money in the form of units having a plurality of denominations, comprising:

means for determining a desired dispensing amount;

means for determining at least two different combinations of monetary units which in total equal the dispensing amount; and means for selecting one of the combinations for use when dispensing, wherein the selection means chooses between at least:

a higher denomination priority principle combination, whereby relatively high denomination units are dispensed in preference to relatively low denomination units; and a modified higher denomination combination principle, whereby a number of units of one denomination is dispensed which differs from that determined by the higher denomination priority principle and then the remaining amount is calculated according to the higher denomination priority principle to reach the desired dispense amount, irrespective of the quantities of units of each of the plurality of denominations which are available for dispensing.

11. Apparatus for controlling the dispensing of money in the form of units having a plurality of denominations, comprising:

a plurality of containers wherein each container holds units of a particular denomination;

a microprocessor that selects between at least two different dispensing combinations of units which in total equal a desired dispensing amount;

wherein the dispensing combinations include a first combination formed by considering the denominations in value order, with higher value units taking priority such that a unit of higher denomination in the combination is included in preference to lower denomination units whenever possible, and a second dispensing combination formed by choosing at least one unit out of value order and including that unit in the combination irrespective of the quantities of units of each of the plurality of denominations available for dispensing; and a dispenser for dispensing units in accordance with the dispensing selection.

12. A money handling apparatus for controlling the dispensing of money in the form of units available in a plurality of different denominations, comprising:

a plurality of containers wherein each container holds money of a different denomination;

a microprocessor which controls the dispensing of units and that utilizes at least two alternative principles according to which combinations of units which sum to a desired dispense amount may be dispensed, the two alternative principles being capable of providing different respective combinations for the same desired dispense amount;

wherein one of the principles is selected in dependence on the numbers of units currently available for dispensing and the selection process is arranged such that the quantity of units in a container influences the selection differently depending on whether or not a maximum capacity for said container is reached, so that if the maximum capacity is reached there is greater tendency to dispense a unit from the container and thus improve the distribution of units retained for future dispensing; and a dispenser for dispensing a combination of units in accordance with the selected principle.

13. The apparatus of claim 12, further comprising:

a validator for authenticating money; and a separator connected to the validator and to the containers, for separating and guiding units to a container according to denomination.

14. The apparatus of claim 12, further comprising a cashbox for accepting units of a denomination when the maximum capacity for a container is reached.

15. A money dispensing apparatus that dispenses change using coins selected from a set of denominations, comprising:

a plurality of coin containers wherein each container holds coins of a different denomination;

a microprocessor that selects between different change combinations, wherein, when all denominations in the set are available for change irrespective of the selected combination, a decision is made prior to dispensing any coin, said decision being dependent on the quantities of coins currently available for dispensing, and said decision determining whether:

(a) coins are dispensed according to a least coin payout principle, taking into account all of the denominations, whereby a relatively high denomination coin is dispensed in preference to relatively low denomination coins which sum to an amount equal to the relatively high denomination coin; or (b) coins are dispensed according to a modified version of said least coin payout principle, the modified version resulting in an exception being made to the least coin principle so as to improve the distribution of retained coins for future dispensing, the coins forming the combination otherwise being determined according to the least coin principle taking into account all of the denominations; and a dispenser for dispensing coins in accordance with said decision, and wherein the microprocessor is not influenced by changes in the subsequent number of available units occurring as a result of the dispensing operation.

16. A money handling apparatus for controlling the dispensing of money in the form of units of each of a plurality of denominations, when units of each of said plurality of denominations are available for dispensing, comprising:

a plurality of containers wherein each container holds money of a different combination;

a microprocessor which controls the dispensing of units by utilizing at least two alternative principles according to which combinations of units which sum to a desired dispense amount may be dispensed, and selects between the principles in dependence on a quantity of units, held in the apparatus, of at least one of the plurality of denominations, so as to tend to improve the distribution of units retained for future dispensing, wherein the alternative principles include:

(a) a higher denomination priority principle, whereby relatively high denomination units are dispensed in preference to relatively low denomination units; and (b) a modified version of the higher denomination priority principle, the modified version including an exception to the higher denomination priority principle, irrespective of the quantities of units of each of said plurality of denominations which are available for dispensing; and a dispenser for dispensing money.

* * * * *